US005314235A

United States Patent [19]

Johnson

[11] Patent Number: 5,314,235

[45] Date of Patent: May 24, 1994

[54] PORTABLE BACK SUPPORT

[76] Inventor: David G. Johnson, P.O. Box 2265, Orillia Ontario, Canada, L3V 6S1

[21] Appl. No.: 788,163

[22] Filed: Nov. 5, 1991

[51] Int. Cl.[5] ..... A47C 3/00

[52] U.S. Cl. ..... 297/284.5; 297/284.6; 297/284.7; 297/452.3; 297/DIG. 3; 297/452.34; 297/452.41

[58] Field of Search ..... 297/284.1, 284.6, 284.5, 297/284.7, 284.9, 284.4, 460, 452.3, 452.29, 452.32, 452.33, 452.34, 452.35, 452.41, 452.48, DIG. 3, 452.36

[56] References Cited

U.S. PATENT DOCUMENTS

| | | | |
|---|---|---|---|
| 3,974,827 | 8/1976 | Bodeen | 297/284.6 X |
| 4,506,929 | 3/1985 | Josefek | 297/460 X |
| 4,516,568 | 5/1985 | Baxter et al. | 297/284 D X |
| 4,518,200 | 5/1985 | Armstrong | 297/284 E |
| 4,556,254 | 12/1985 | Roberts | 297/460 |
| 4,572,578 | 2/1986 | Perkins | 297/460 |
| 4,696,516 | 9/1987 | Yeum | 297/460 X |
| 4,718,724 | 1/1988 | Quinton et al. | 297/284.7 X |
| 4,759,543 | 7/1988 | Feldman | 297/284 E X |
| 4,789,202 | 12/1988 | Alter | 297/284 E |
| 4,834,455 | 5/1989 | Proctor | 297/284 F X |
| 4,835,801 | 6/1989 | Walpin et al. | 297/460 X |
| 5,054,854 | 10/1991 | Pruit | 297/284.6 X |
| 5,076,643 | 12/1991 | Colasanti et al. | 297/284.6 |
| 5,211,446 | 5/1993 | Fay et al. | 297/284.7 X |

FOREIGN PATENT DOCUMENTS

| | | | |
|---|---|---|---|
| 2469315 | 5/1981 | France | 297/284 D |

*Primary Examiner*—Kenneth J. Dorner
*Assistant Examiner*—Milton Nelson, Jr.
*Attorney, Agent, or Firm*—Moss, Barrigar & Oyen

[57] ABSTRACT

Disclosed herein is a portable back support comprising a base plate, cushion means attached to the base plate: the cushion means having an upper portion and a lower portion, the lower portion having a pair of laterally spaced extremities, the base plate having an arcuate shape in transverse section thereby enabling the extremities to provide lateral support: the lower portion further comprising expansion means, the expansion means enabling the contour of the cushion to be varied.

11 Claims, 8 Drawing Sheets

PORTABLE BACK SUPPORT

The present invention relates to portable back supports.

The spine, and more particularly the muscles and tendons supporting it, is a common source of discomfort for a great many people. Numerous attempts have been made to relieve this discomfort, including the use of portable back supports.

It is generally known that changes in the degree of extension of the spine- slightly, moderately, or dramatically-alters the weight bearing position of the vertebrae. In effect, the configuration of the spine is in a state of continuous change according to changes in loads exerted on it. Although conventional portable back supports offer satisfactory relief, most have a profile that cannot be adjusted to accommodate these physiological changes.

Furthermore, conventional portable back supports fail to offer precise support to the wide variety of back configurations, particularly in the thoracic, lumbar spines and more particularly the vertebrae.

It is therefore an object of the present invention to provide a novel portable back support.

According to one aspect of the invention, a portable back support comprises a base plate and cushion means attached to a front of the base plate and having an upper portion and a lower portion. The lower portion has a pair of laterally spaced extremities. The base plate has an arcuate shape in transverse section thereby enabling the extremities to provide lateral support. There is also an adjustable expansion means enabling the contour of the cushion to be varied. The expansion means comprises an inflatable bladder capable of providing increased support for the lumbar spine of a user and movably connected to the base plate. The bladder has a rear surface firmly supported by the base plate. There are also means for displacing the bladder vertically relative to the base plate.

Preferably the cushion further comprising a projection extending along a central region of the cushion and restricted to a relatively small area centred thereon in order to engage a region on the back of a user adjacent the vertebrae.

According to another aspect of the invention, a portable back support comprises a base plate having a top, a bottom, a front surface and a rear surface, and a cushion layer extending over the front surface of the base plate. The cushion layer is connected to the base plate and has an upper portion and a lower portion. An inflatable bladder is mounted between the base plate and the lower portion and is capable of providing further support for the lumbar spine of a user. The bladder is firmly supported by the front surface of the base plate. There are also means for displacing the bladder vertically relative to the base plate so as to enable the bladder to accommodate variations in the location of the lumbar spine.

Several preferred embodiments will now be described, by way of example only, as illustrated in the appended drawings in which.

Figure 1:
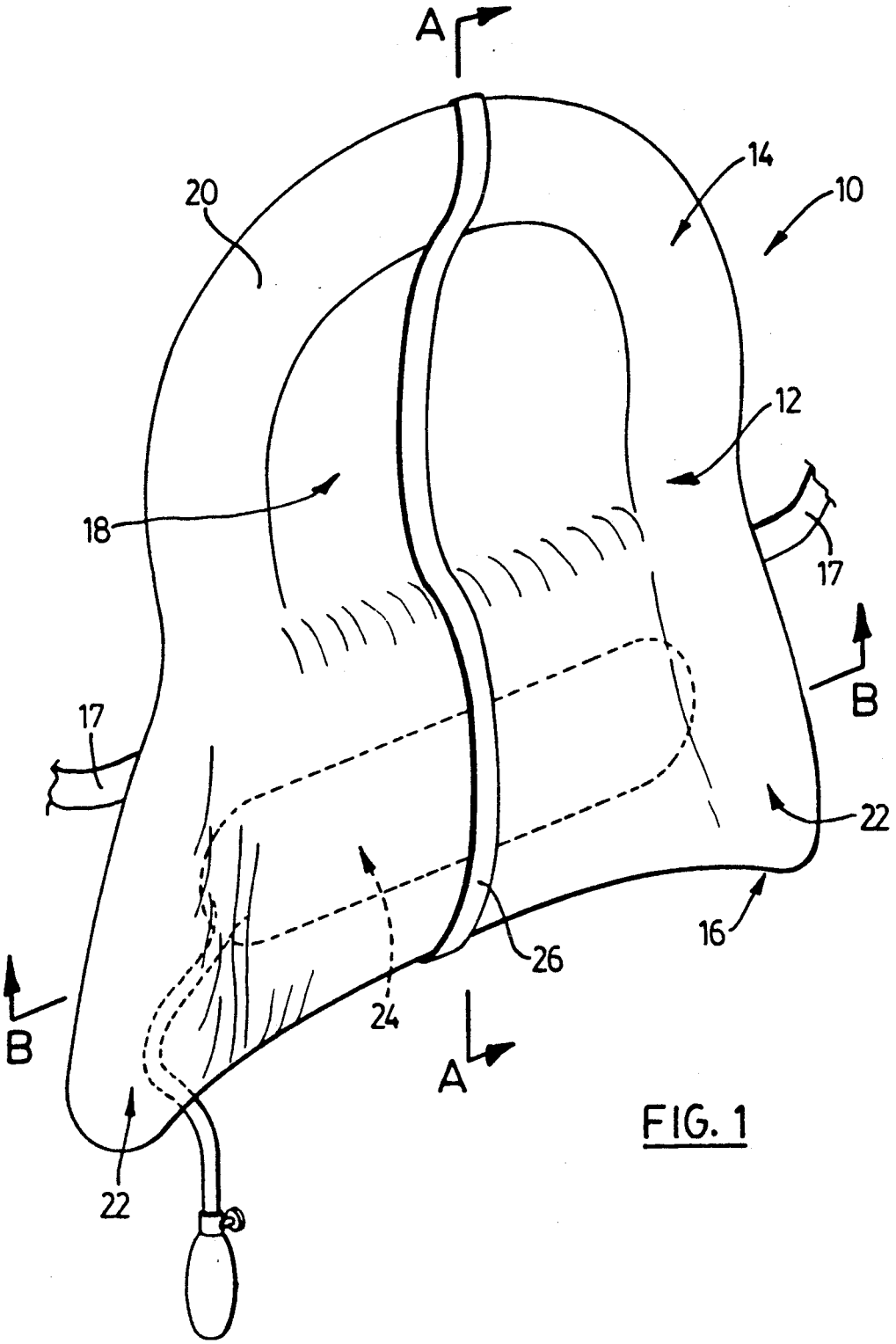
FIG. 1 is a perspective view of a portable back support.
Figure 2:
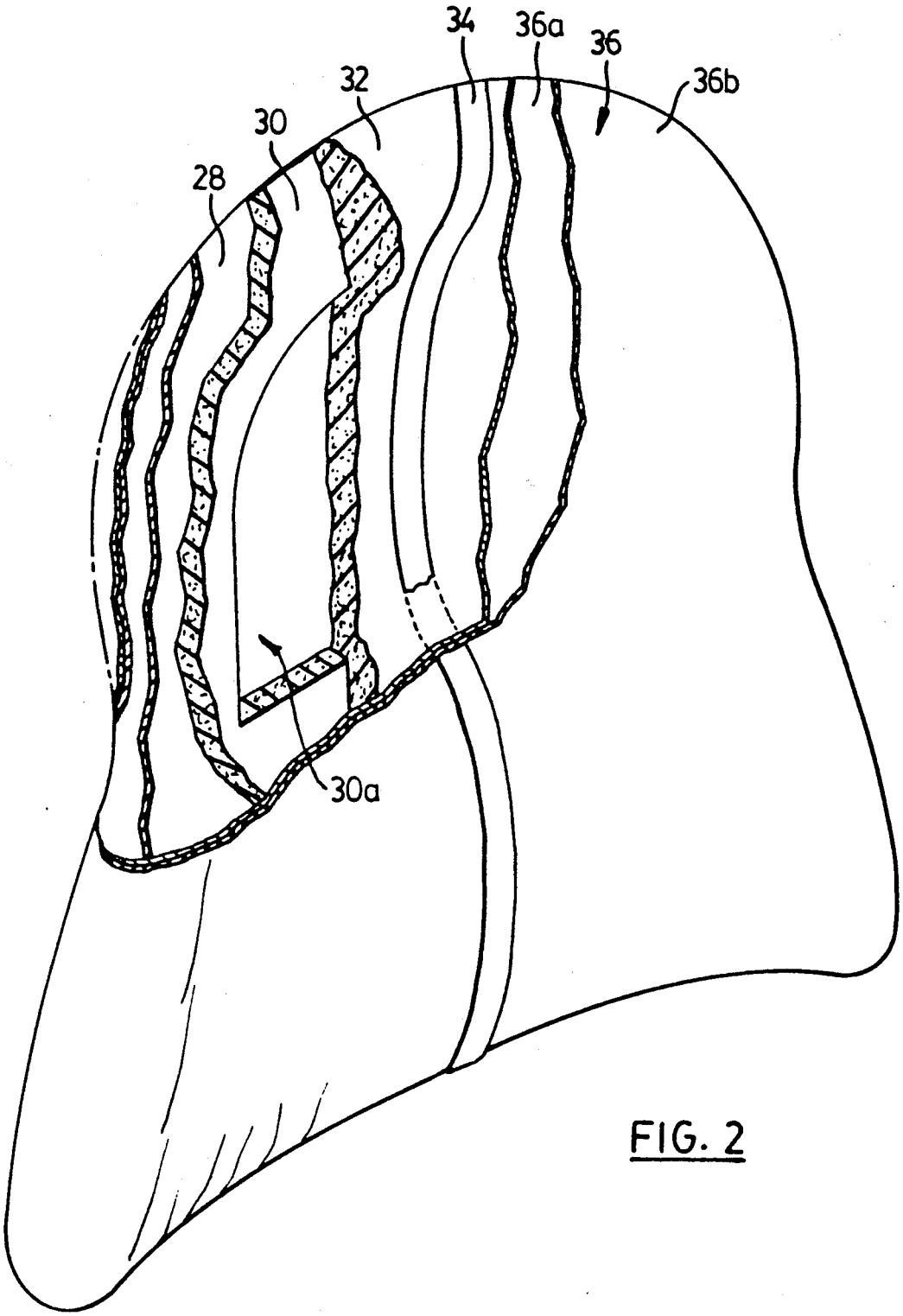
FIG. 2 is a cut-away perspective view of the portable view of the portable back support illustrated in FIG. 1.
Figure 7:
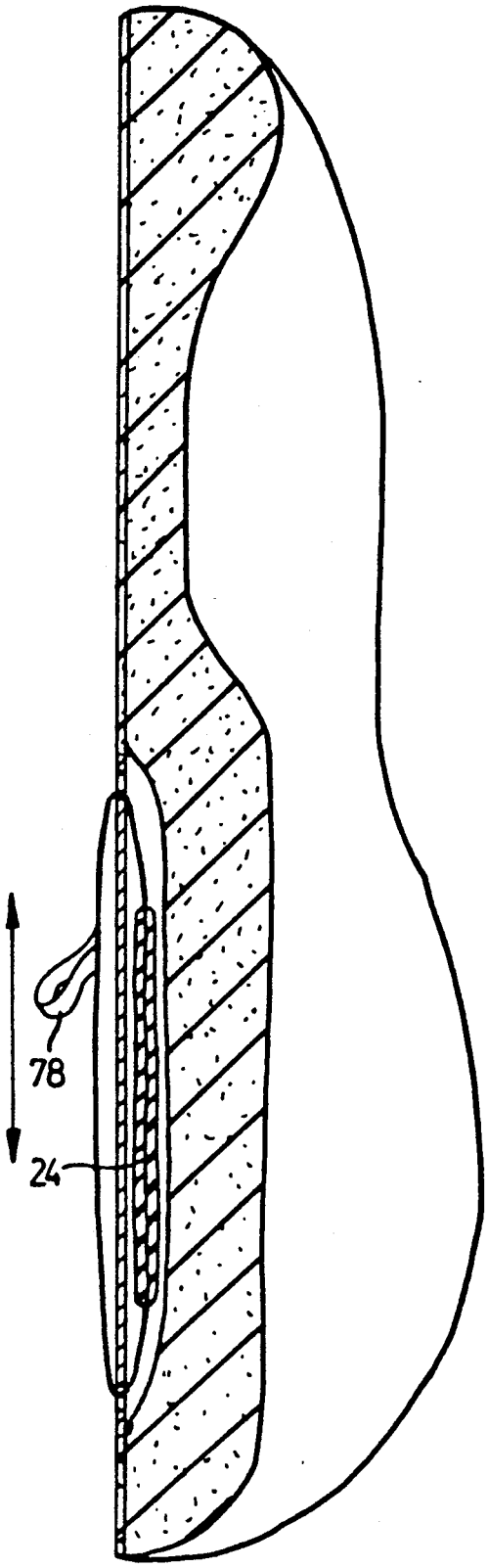
FIG. 7 is a sectional view of another portable back support taken with respect to line A—A of FIG. 1.
Figure 7A:
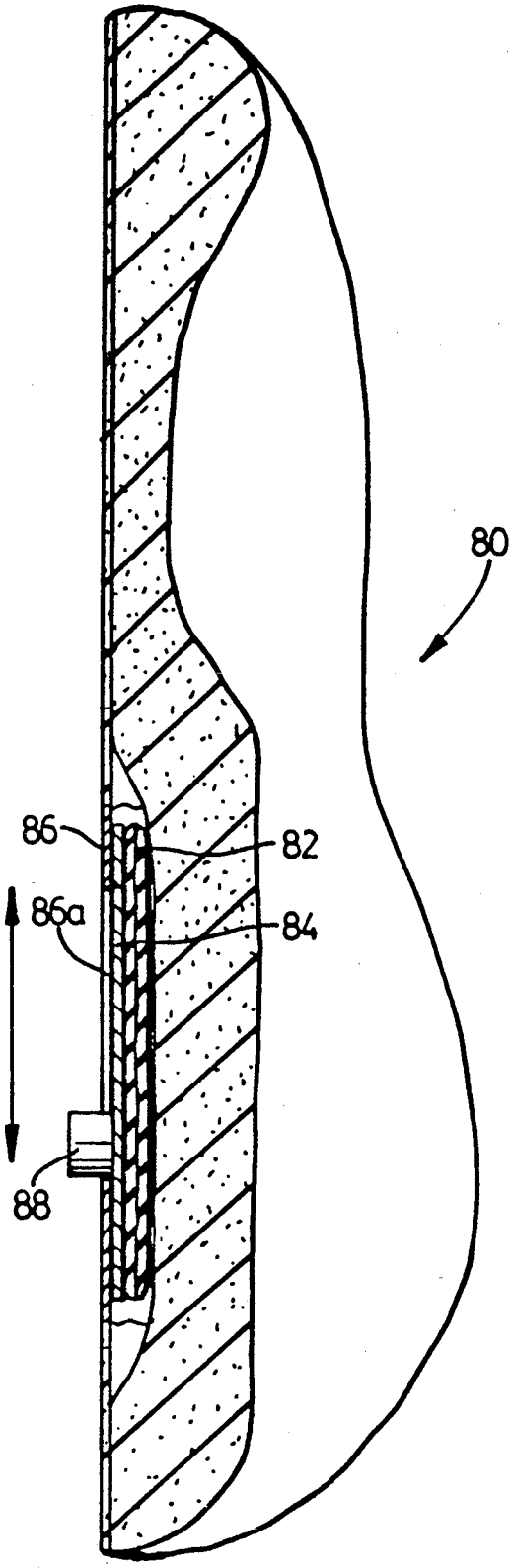
Figure 8:
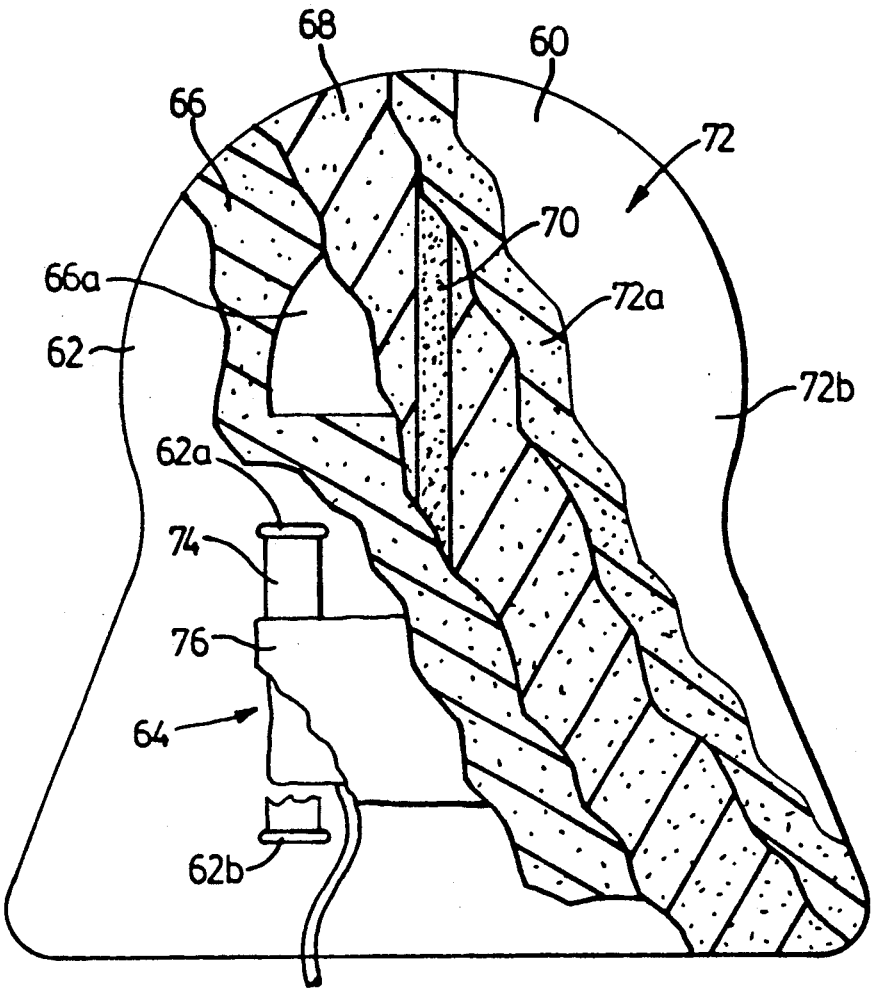

FIG. 7*a* is a sectional view of yet another portable back support taken with respect to line A—A of FIG. 1;

FIG. 8 is a fragmentary front view of the portable back support of FIG. 7.

Referring to the figures, there is provided a portable back support 10 having a cushioned front face 12. As shown in FIG. 1*a*, the portable back support 10 has a frontal outline similar to that of a key-hole, with an upper generally semi-circular portion 14 and a lower generally rectilinear portion 16. The portable back support 10 is also provided with a pair of straps 17 to secure the portable back support 10 to a chair in the desired position.

As will be described in more detail below, the portable back support 10 offers support in the following manner:

i) The upper portion 14 has a semi-circular depression 18 bordered by a relatively thick collar portion 20 to support the thoracic spine while accommodating its natural kyphosis, that is the natural flexion, occurring in the thoracic spine.

ii) The lower portion 16 has a pair of laterally spaced lower extremities 22 to provide lateral support for the user's back and more particularly the muscles and connective tissue therein.

iii) The lower portion 16 has an inflatable bladder 24 to provide support to the lumbar spine. In a later embodiment as will be described, the bladder is vertically adjustable to accommodate variations in the user's height.

iv) A projection is provided at 26 which, in its operative position, extends vertically along the central region of the portable back support 10 and through both the upper and lower portions 14, 16 and provides direct contact and support to the vertebrae.

The use of the projection 26 is significant in that the region of the back adjacent the vertebrae is generally concave. Therefore, the projection assists in providing the same (and in some cases more) support to the spinal region.

As best seen in FIGS. 3 to 6, the portable back support 10 has a base plate 28 which is linear in longitudinal section and is curved in transverse section.

Bonded to the base plate 28 in the lower region is an inflatable bladder 24, which is inflated by the use of a bulb 24*a*. An inner layer of foam 30 is bonded to the base plate 28 and to the bladder 24. The inner layer 30 has a semicircular cut-out 30*a* in the upper region to form the depression 18. The inner layer 30 also has an elongate cut-out 30*b* along its lower edge to enhance the supporting capability of the extremities 22.

An outer layer of foam 32 is bonded to the inner layer of foam 30. The outer layer 32 has a similar outline to that of the inner layer 30 and is bonded to the base plate 28 through the two cut-outs. Bonded to the outer layer 32 is a ridge of foam 34 to form the projection 26.

A skin 36 covers the outer layer of foam on the front of the portable back support 10 and the base plate on the rear of the portable back support 10. The skin has a relatively thin layer of foam 36*a* which is laminated to a layer of cloth 36*b* for durability and comfort. Alternatively, the ridge may be formed from a similar resiliency of foam and have a higher profile.

Another feature of the portable back support 10 is its stretched B-shaped profile with an upper lobe of the 'B' appearing at 38 and the lower lobe at 40. This contour corresponds to the stretched S-shaped profile as is generally found in spines as shown in dashed lines at 42 in FIG. 5. Furthermore, the upper boundary 40*a* of the lower lobe 40 is positioned to align with the transition area between the lumbar and thoracic spines, namely in the area of vertebrae T12 and L1.

Figure 3:
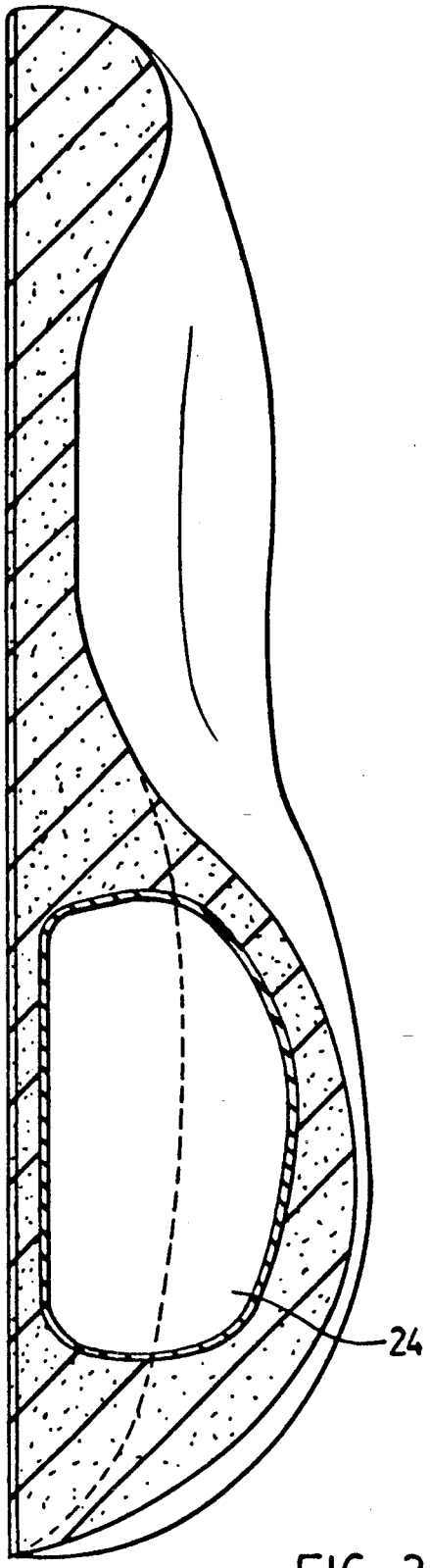
FIG. 3 is a schematic view taken on line A—A of FIG. 1.
Figure 4:
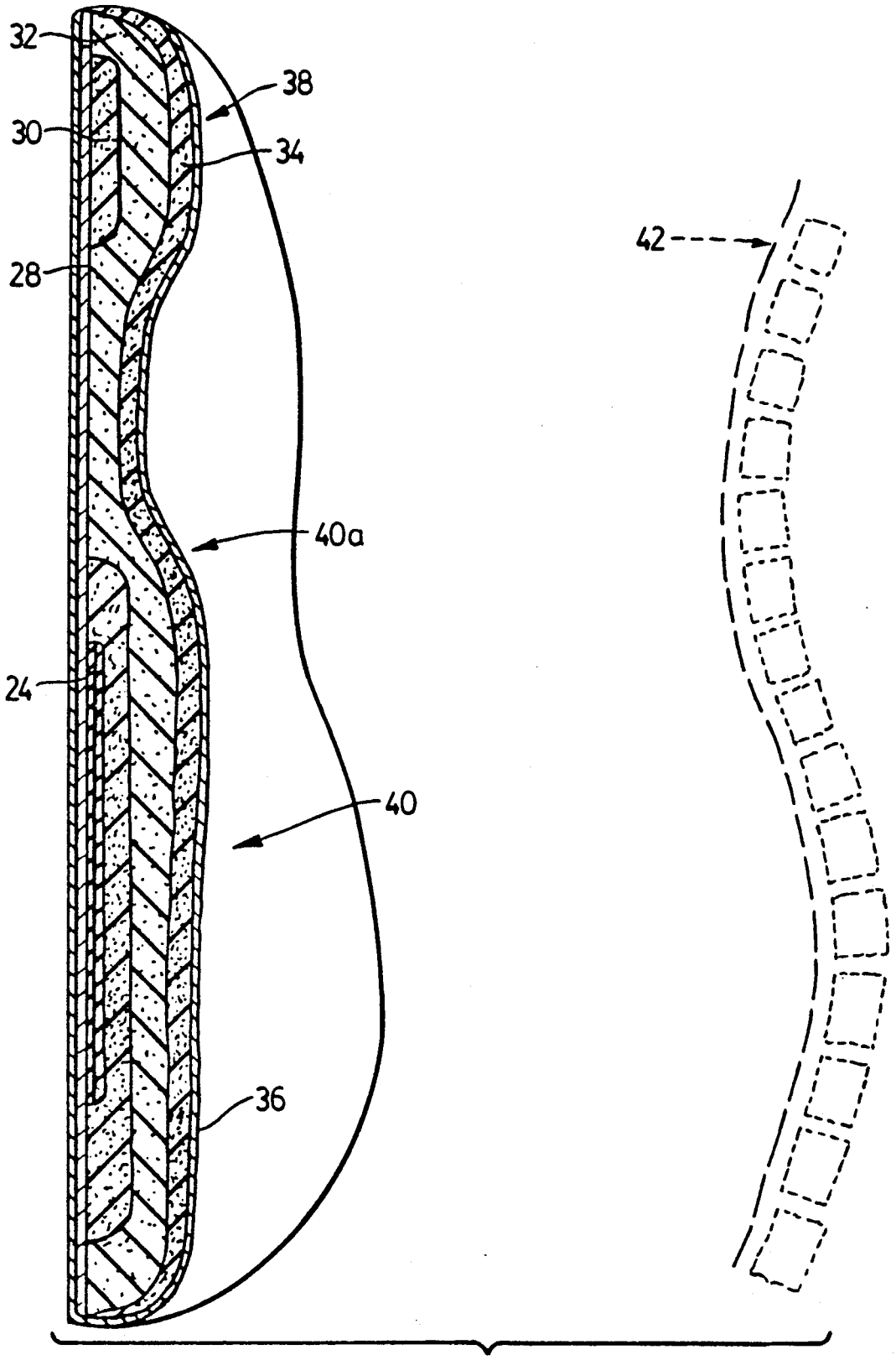
FIG. 4 is a sectional view taken on line A—A of FIG. 1.
Figure 5:
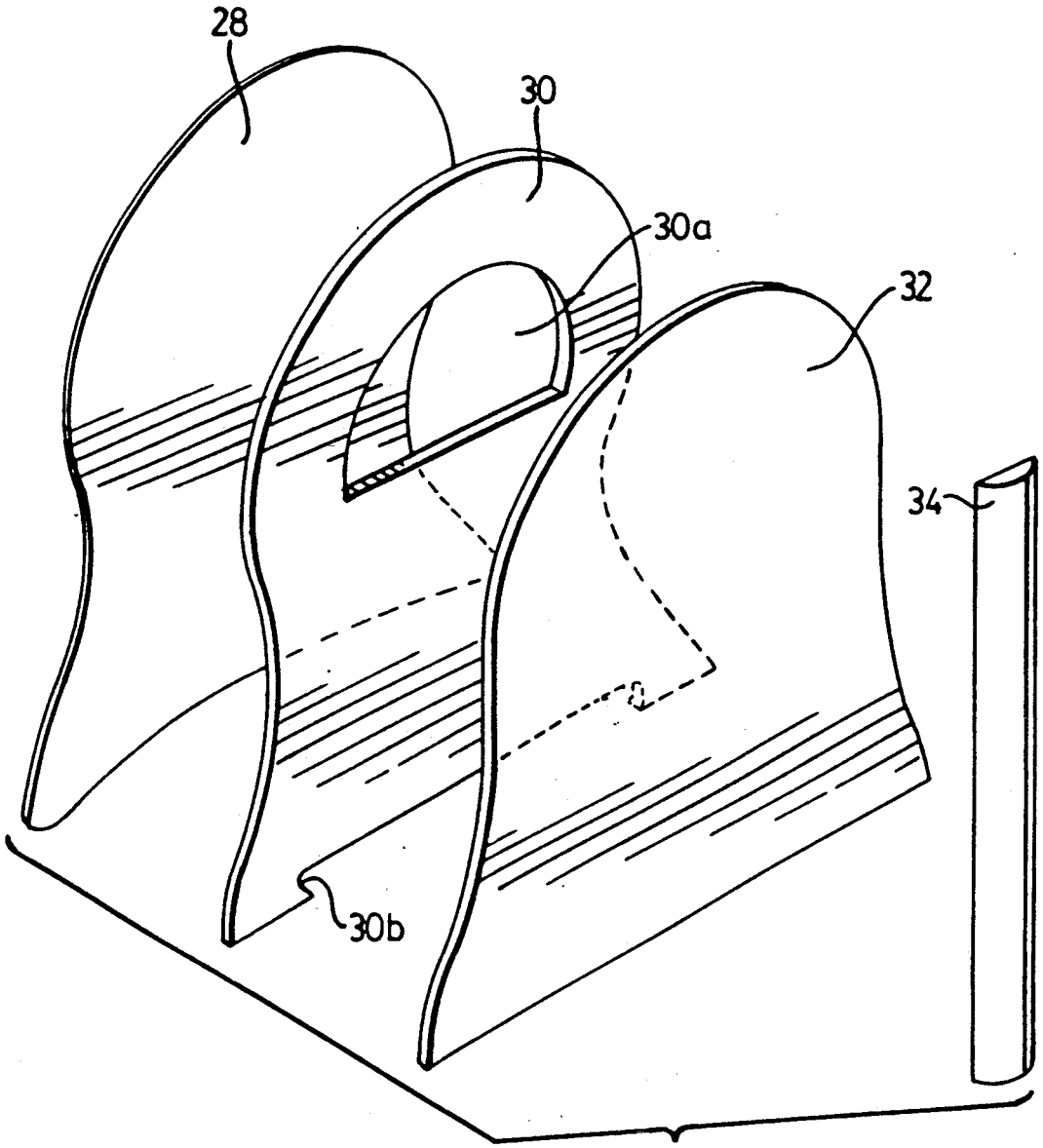
FIG. 5 is an exploded view of one portion of the portable back support illustrated in FIG. 1.
Figure 6:
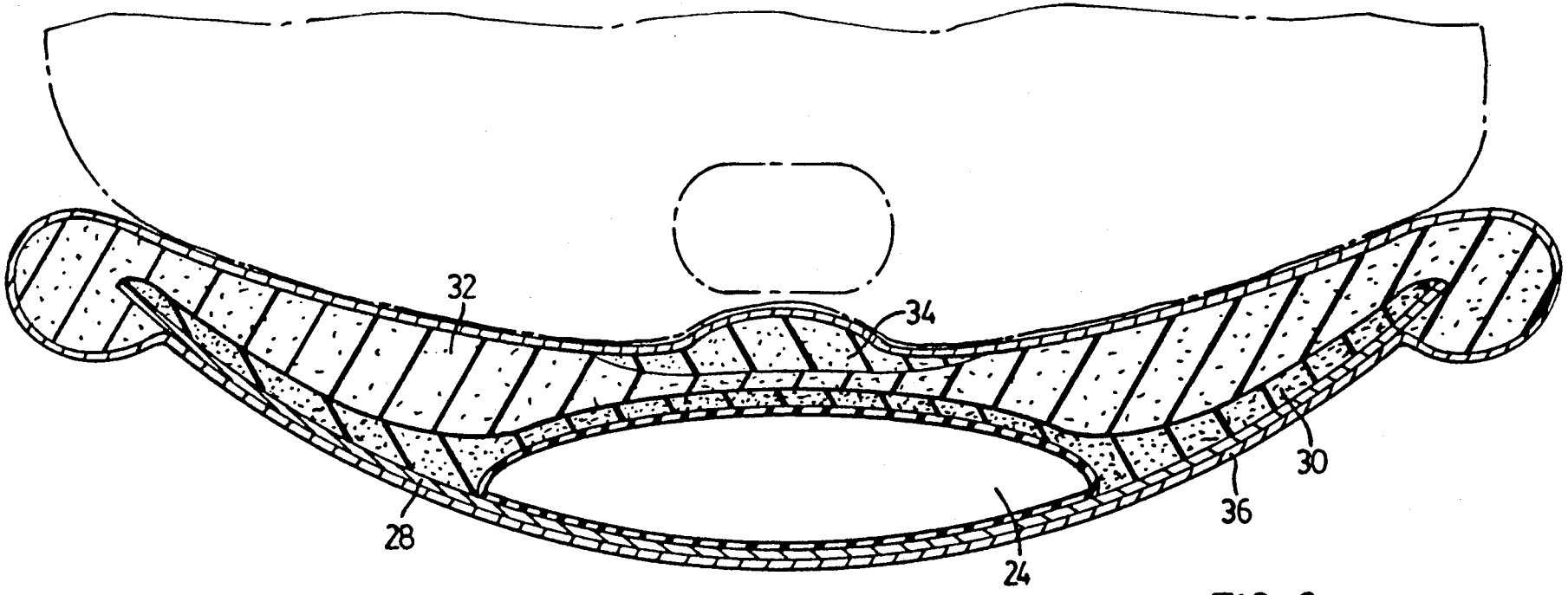
FIG. 6 is a sectional view taken on line B—B of FIG. 1.

By adjusting the inflation of the bladder 24, for example as shown by FIGS. 3 and 4, the user may also conveniently adjust the stretched B-shaped profile of the portable back support 10 to correspond to the changing contour of the user's spine.

In use, the portable back support 10 is placed at the desired position with the upper boundary aligned with the junction of the lumbar and thoracic spines. The user then rests against the portable back support 10 by aligning his vertebra with the central projection 26. The user may then adjust the degree of support in the lumbar spine by inflating the bladder 24 using the bulb 24*a*.

Another portable back support is shown at 50 in FIGS. 10 and 11. The portable back support 50 is identical to the portable back support 10 but without the upper portion. With this arrangement, the user may benefit from the lumbar support of the cushion with the central projection, shown at 52, to support the vertebrae, but of course without the support of the thoracic spine.

Another back support 60 is illustrated in FIG. 8 which is provided with a base plate 62 and a bladder 64. Further provided is a displacement means to displace the bladder relative to the base plate 62. The portable back support 60 also includes an inner layer of foam 66 with the semi-circular cut-out 66*a*, an outer layer of foam 68, a ridge 70 and an outer skin 72 including a foam inner layer 72*a* and a cloth outer layer 72*b*.

The displacement means includes two upper apertures 62*a* and two lower apertures 62*b* formed in the base plate. Extending though a corresponding pair of these apertures are a pair of straps 74 which are attached to either end of an outer retention bag 76 which carries the bladder 64. The retention bag 76 is capable of moving along the base plate 62 through a gap formed between the face of the base plate and the inner layer of foam 66. A ring 78 is attached to the straps and may be grasped by the user to adjust the position of the bladder 24 relative to align with the user's lumbar spine.

Still another portable back support is illustrated at 80 in FIG. 7*a*. In this case, the bladder 82 is mounted on a disc 84 which in turn is slidably engaged with the base plate 86. Attached to the disc is a handle 88 that extends through an aperture 86*a* in the base plate 86. Like the previous embodiment, the portable back support 80 is adjustable relative to the base plate.

If desired, the supporting capability of the projection may be enhanced by using an inflatable bladder, for example, by inserting another bladder 24 behind the ridge. Similarly, other areas may be provided with air bags depending on the degree of adjustment needed in particular circumstances.

The portable back support 10 may of course be manufactured a number of different ways including combining the inner and outer layers with the ridge into a single blank of foam. In addition, other layers of foam may be placed on the anterior side of the bladder to offer further support, if desired, to the lumbar spine.

I claim:

1. A portable back support comprising a base plate extending substantially the height of said support, cushion means attached to a front of said base plate and having an upper portion and a lower portion, said lower portion having a pair of laterally spaced extremities, said base plate having an arcuate shape in transverse section thereby enabling said extremities to provide lateral support, adjustable expansion means enabling the contour of said cushion means to be varied, said expansion means comprising an inflatable bladder capable of providing increased support for the lumbar spine of a user, said bladder having a rear surface which is firmly supported by the front of said base plate, and means for displacing said bladder vertically relative to said base plate so as to enable said expansion means to accommodate variations in the location of the lumbar spine.

2. A portable back support as defined in claim 1 wherein said upper portion includes a depression of a size sufficient to accommodate a thoracic spine.

3. A portable back support as defined in claim 2 wherein said upper portion includes an upper lobe, said lower portion includes a lower lobe, and said upper and lower lobes are separated by said depression.

4. A portable back support comprising a base plate having a top, a bottom, a front surface and a rear surface, a cushion layer extending over said front surface of the base plate, said cushion layer being connected to said base plate and having an upper portion and a lower portion, an inflatable bladder mounted between said base plate and said lower portion and capable of providing further support for the lumbar spine of a user, said bladder being firmly supported by said front surface of the base plate, and means for displacing said bladder vertically relative to the base plate so as to enable the bladder to accommodate variations in the location of the lumbar spine.

5. A portable back support as defined in claim 4 wherein said displacing means comprises a flat plate member on which said bladder is mounted and a handle extending rearwardly from said flat plate and through an aperture formed in said base plate.

6. A portable back support as defined in claim 4 including a vertical cushion ridge extending along a central vertical axis of said support and extending only a relatively short distance in the transverse direction so as to engage a region of a user's back adjacent the vertebrae.

7. A portable back support as defined in claim 6 wherein said ridge extends substantially the entire height of the support.

8. A portable back support as defined in claim 4 including means for inflating said bladder.

9. A portable back support as defined in claim 8 wherein said upper portion of the cushion layer has a depression of a size sufficient to accommodate a thoracic spine.

10. A portable back support as defined in claim 9 wherein said upper portion includes an upper lobe, said lower portion includes a lower lobe, and said upper and lower lobes are separated by said depression.

11. A portable back support as defined in claim 8 wherein said displacing means comprises an outer retention bag and a pair of straps attached to opposite ends of said bag, said bladder being contained within said bag and said straps extending through upper and lower apertures formed in said base plate.

* * * * *